US010337360B2

(12) United States Patent
Zurface

(10) Patent No.: US 10,337,360 B2
(45) Date of Patent: Jul. 2, 2019

(54) METHOD FOR SETTING LASH IN A MECHANICALLY LASHED VALVETRAIN HAVING A SWITCHING ROCKER ARM

(71) Applicant: Eaton Corporation, Cleveland, OH (US)

(72) Inventor: Austin Zurface, Hastings, MI (US)

(73) Assignee: Eaton Corporation, Cleveland, OH (US)

( * ) Notice: Subject to any disclaimer, the term of this patent is extended or adjusted under 35 U.S.C. 154(b) by 345 days.

(21) Appl. No.: 15/405,450

(22) Filed: Jan. 13, 2017

(65) Prior Publication Data

US 2017/0122135 A1 May 4, 2017

Related U.S. Application Data

(63) Continuation of application No. PCT/US2015/040358, filed on Jul. 14, 2015.
(Continued)

(51) Int. Cl.
*F01L 1/18* (2006.01)
*F01L 1/20* (2006.01)
(Continued)

(52) U.S. Cl.
CPC ..... *F01L 1/205* (2013.01); *F01L 1/185* (2013.01); *F01L 1/20* (2013.01); *F01L 1/2405* (2013.01);
(Continued)

(58) Field of Classification Search
CPC ... F01L 1/205; F01L 1/185; F01L 1/24; F01L 1/20; F01L 1/2405; F01L 13/0005;
(Continued)

(56) References Cited

U.S. PATENT DOCUMENTS 5,584,267 A 12/1996 Muir
8,215,275 B2 7/2012 Church
2007/0089698 A1* 4/2007 Stretch ..... F01L 1/2411 123/90.16
2008/0216784 A1 9/2008 Himsel et al.
(Continued)

FOREIGN PATENT DOCUMENTS

EP 2743469 A1 6/2014
JP H0617126 A 11/1994
(Continued)

OTHER PUBLICATIONS

European Search Report for EP Application No. 15822515.1 dated Mar. 6, 2018, 8 pages.
(Continued)

*Primary Examiner* — Zelalem Eshete
(74) *Attorney, Agent, or Firm* — RMCK Law Group PLC

(57) ABSTRACT

A method for setting lash on a switching rocker arm assembly includes providing a rocker arm having (i) an outer arm having a first outer side arm and a second outer side arm, the outer arm defining an opening, (ii) an inner arm disposed between the first and second outer side arms, (iii) a roller follower that selectively engages a cam, the roller follower mounted about a bearing axle that extends through the opening. A zero lash shim is inserted into a gap defined between the bearing axle and the outer arm at the opening. The rocker arm is installed into the valvetrain with the master tip cap. Lash is measured between the cam and the roller follower. The rocker arm and the master tip cap is removed. A select fit valve tip cap is installed based on the master tip cap and the measured lash.

20 Claims, 4 Drawing Sheets

Related U.S. Application Data

(60) Provisional application No. 62/024,409, filed on Jul. 14, 2014.

(51) Int. Cl.
*F01L 1/24* (2006.01)
*F01L 13/00* (2006.01)

(52) U.S. Cl.
CPC ..... *F01L 13/0005* (2013.01); *F01L 1/24* (2013.01); *F01L 2001/186* (2013.01); *F01L 2013/001* (2013.01); *F01L 2103/01* (2013.01); *F01L 2105/00* (2013.01); *F01L 2800/09* (2013.01)

(58) Field of Classification Search
CPC ..... F01L 2105/00; F01L 2013/001; F01L 2001/186; F01L 2103/01; F01L 2800/09
See application file for complete search history.

(56) References Cited

U.S. PATENT DOCUMENTS

| | | | |
|---|---|---|---|
| 2008/0271693 | A1 | 11/2008 | Edelmayer et al. |
| 2009/0217895 | A1 | 9/2009 | Spath et al. |
| 2009/0308339 | A1 | 12/2009 | Hendriksma |
| 2013/0000582 | A1 | 1/2013 | Church |

FOREIGN PATENT DOCUMENTS

| | | | |
|---|---|---|---|
| JP | 2013185465 | A | 9/2013 |
| KR | 1020050061721 | A | 6/2005 |

OTHER PUBLICATIONS

International Search Report and Written Opinion for International Application No. PCT/US2015/040358 dated Oct. 21, 2015, 10 pages.

* cited by examiner

METHOD FOR SETTING LASH IN A MECHANICALLY LASHED VALVETRAIN HAVING A SWITCHING ROCKER ARM

CROSS-REFERENCE TO RELATED APPLICATIONS

This application is a continuation of International Application No. PCT/US2015/040358 filed Jul. 14, 2015, which claims the benefit of U.S. Patent Application No. 62/024,409 filed on Jul. 14, 2014. The disclosure of the above application is incorporated herein by reference.

FIELD

The present disclosure relates generally to setting lash in a valvetrain of an internal combustion engine that incorporates switching roller finger followers or rocker arms.

BACKGROUND

Variable valve actuation (VVA) technologies have been introduced and documented. One VVA device may be a variable valve lift (VVL) system, a cylinder deactivation (CDA) system such as that described in U.S. Pat. No. 8,215,275 entitled "Single Lobe Deactivating Rocker Arm" hereby incorporated by reference in its entirety, or other valve actuation systems. Such mechanisms are developed to improve performance, fuel economy, and/or reduce emissions of the engine. Several types of the VVA rocker arm assemblies include an inner rocker arm within an outer rocker arm that are biased together with torsion springs.

Switching rocker arms allow for control of valve actuation by alternating between latched and unlatched states. A latch, when in a latched position causes both the inner and outer rocker arms to move as a single unit. When unlatched, the rocker arms are allowed to move independent of each other. In some circumstances, these arms can engage different cam lobes, such as low-lift lobes, high-lift lobes, and no-lift lobes. Mechanisms are required for switching rocker arm modes in a manner suited for operation of internal combustion engines.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A method for setting lash on a switching rocker arm assembly includes providing a rocker arm having (i) an outer arm having a first outer side arm and a second outer side arm, the outer arm defining an opening, (ii) an inner arm disposed between the first and second outer side arms, (iii) a roller follower that selectively engages a cam, the roller follower mounted about a bearing axle that extends through the opening; and (iv) a pivot axle wherein the inner arm and the outer arm rotate relative to each other about the pivot axle. A zero lash shim is inserted into a gap defined between the bearing axle and the outer arm at the opening. The rocker arm is installed into the valvetrain with the master tip cap. Lash is measured between the cam and the roller follower. The rocker arm and the master tip cap is removed. A select fit valve tip cap is installed based on the master tip cap and the measured lash.

According to additional features, the zero lash shim is placed into a kidney bean shaped opening defined in the outer arm. Subsequent to inserting the zero lash shim, the rocker arm is held at a zero lash condition. Holding the rocker arm at the zero lash condition includes engaging a finger of a rocker arm latch in contact with an engaging ridge on the inner arm. Installing the rocker arm into valvetrain with the master tip cap occurs subsequent to holding the rocker arm at the zero lash condition.

According to other features measuring lash between the cam and the roller follower includes inserting a feeler gage between the cam and the roller follower. Installing the select fit tip cap includes choosing a select fit tip cap from a plurality of different sized valve tip caps. Lash is verified between the cam and the roller follower subsequent to installing the select fit tip cap. Verifying lash includes inserting a feeler gage between the cam and the roller follower.

According to still additional features, the zero lash shim is removed subsequent to the verifying. Removing the zero lash shim includes creating a latch gap between a finger of a rocker arm latch and an engaging ridge on the inner arm. The latch gap represents the resulting lash. Concurrent to the removing the zero lash shim, the roller follower is urged into engagement with the cam. The pivot axle secures the inner arm to the outer arm while also allowing a rotational degree of freedom wherein one of the outer and inner arms rotates relative to the other of the outer and inner arms about the pivot axle when the switching rocker arm assembly is in a deactivated state.

A method for setting lash on a switching rocker arm assembly according to another example of the present disclosure includes providing a rocker arm having (i) an outer arm having a first outer side arm and a second outer side arm, the outer arm defining an opening, (ii) an inner arm disposed between the first and second outer side arms, (iii) a roller follower that selectively engages a cam, the roller follower mounted about a bearing axle that extends through the opening; and (iv) a pivot axle wherein the inner arm and the outer arm rotate relative to each other about the pivot axle. The rocker arm is held at a zero lash condition. An engaging finger of a rocker arm latch is moved into contact with an engaging ridge on the inner arm. The rocker arm is installed into the valvetrain with a master valve tip cap. Lash is measured between the cam and the roller follower. The rocker arm and master tip cap is removed. A select fit tip cap is chosen from a plurality of different sized valve tip caps based on the master valve tip cap and the measured lash. The chosen select fit valve tip cap is installed.

Lash is verified between the cam and the roller follower subsequent to installing the select fit tip cap. Verifying lash includes inserting a feeler gage between the cam and the roller follower. The zero lash shim is removed subsequent to the verifying. A latch gap is created between the finger of the rocker arm latch and the engaging ridge on the inner arm. The latch gap represents the resulting lash. Concurrent to removing the zero lash shim, the roller follower is urged into engagement with the cam. The pivot axle secures the inner arm to the outer arm while also allowing a rotational degree of freedom wherein one of the outer and inner arms rotates relative to the other of the outer and inner arms about the pivot axle when the switching rocker arm assembly is in a deactivated state.

BRIEF DESCRIPTION OF THE DRAWINGS

The present disclosure will become more fully understood from the detailed description and the accompanying drawings, wherein:

FIG. 1 is a view of an exemplary switching rocker arm constructed in accordance to one example of the present disclosure of which a method for setting lash according to one example of the present disclosure is used on;

DETAILED DESCRIPTION

Figure 1:
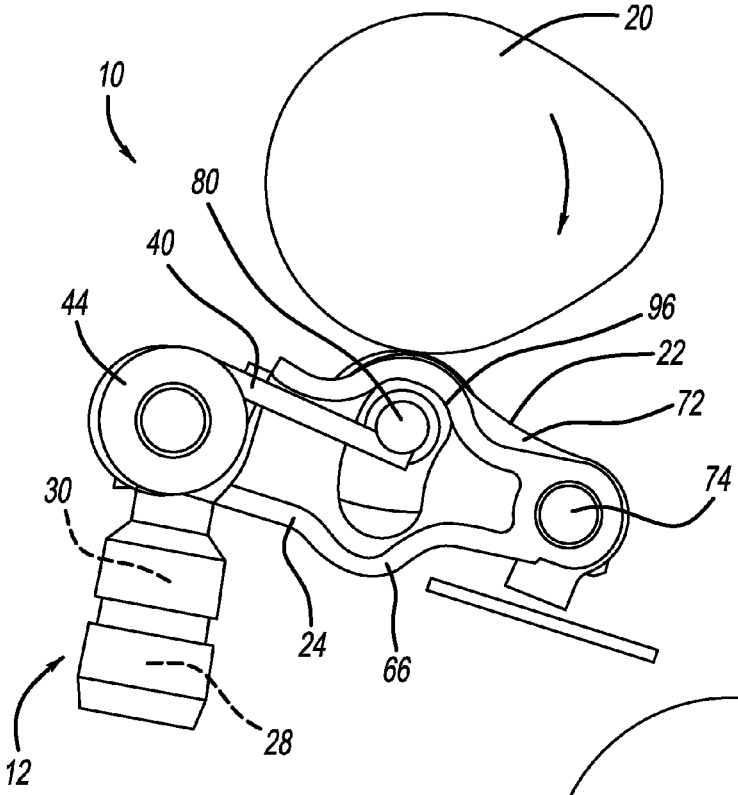
Figure 2:
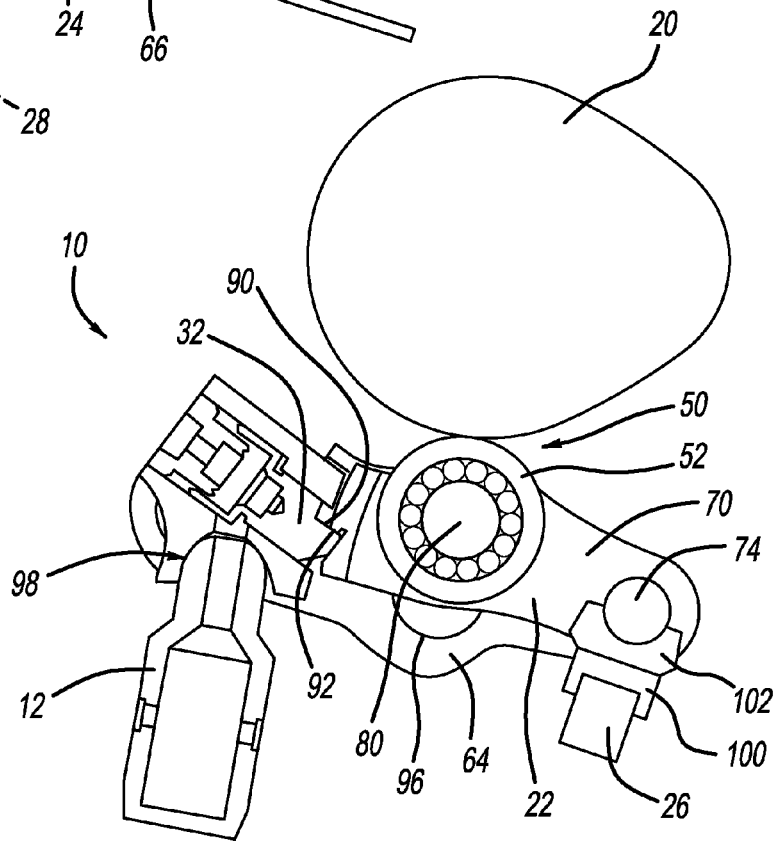
FIG. 2 is a sectional view of the switching rocker arm of FIG. 1.
Figure 3:
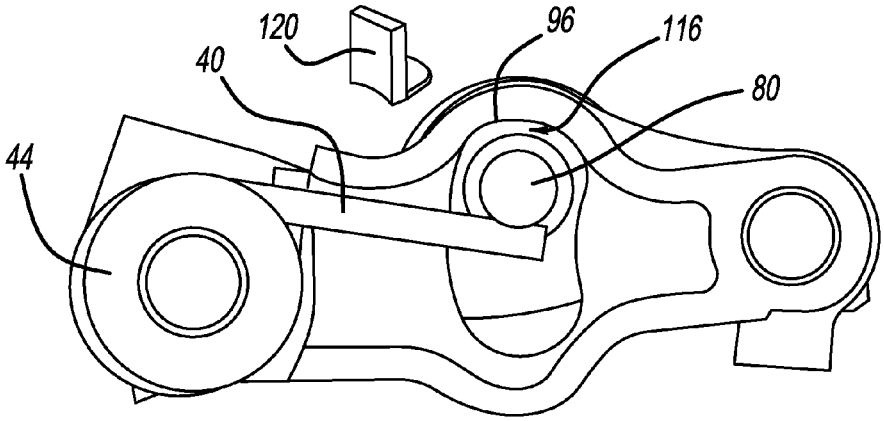
FIG. 3 is a side view of the switching rocker arm of FIG. 2 and shown with a zero lash shim being inserted between a bearing axle and rocker arm kidney bean passage.

With initial reference to FIGS. 1-2, an exemplary switching rocker arm constructed in accordance to one example of the present disclosure is shown and generally identified at reference 10. As will become appreciated herein, the method of setting lash according to the present disclosure will be described using the switching rocker arm 10. The switching rocker arm assembly 10 can be a compact cam-driven single-lobe cylinder deactivation (CDA-1L) switching rocker arm installed on a piston-driven internal combustion engine, and actuated with the combination of a duel-feed hydraulic lash adjusters (DFHLA) 12, also referred to as pivot plungers, that receive oil from oil control valves ("OCV", not shown). The switching rocker arm assembly 10 can be engaged by a single lobe cam 20. The switching rocker arm can include an inner arm 22, an outer arm 24. The default configuration is in the normal-lift (latched) position where the inner arm 22 and the outer arm 24 are locked together, causing an engine valve (not shown) to open and allowing the cylinder to operate as it would in a standard valvetrain. The DFHLA 12 has two oil ports. A lower oil port 28 provides lash compensation and is fed engine oil similar to a standard HLA. An upper oil port 30, referred as the switching pressure port, provides the conduit between controlled oil pressure from the OCV and a latch 32. When the latch 32 is engaged, the inner arm 22 and the outer arm 24 operate together like a standard rocker arm to open the engine valve 26. In the no-lift (unlatched) position, the inner arm 22 and the outer arm 24 can move independently to enable cylinder deactivation.

A pair of lost motion torsion springs 40 are incorporated to bias the position of the inner arm 22 so that it always maintains continuous contact with the camshaft lobe 20. The torsion springs 40 are secured to mounts located on the outer arm 24 by spring retainers 44. The spring retainers 44 retain the torsion springs 40 laterally. The lost motion torsion springs 40 require a higher preload than designs that use multiple lobes to facilitate continuous contact between the camshaft lobe 20 and an inner arm bearing 50 having a roller follower 52.

The outer arm 24 can have a first outer side arm 64 and a second outer side arm 66. The inner arm 22 can be disposed between the first outer side arm 64 and the second outer side arm 66. The inner arm 22 can have a first inner side arm 70 and a second inner side arm 72. The inner arm 22 and the outer arm 24 are both mounted to a pivot axle 74. The pivot axle 74 can be located adjacent to a first end of the rocker arm assembly 10, which secures the inner arm 22 to the outer arm 24 while also allowing a rotational degree of freedom pivoting about the pivot axle 74 when the rocker arm assembly 10 is in a deactivated state. As will be described herein, the pivot axle 74 has an eccentric geometry that allows the pivot axle 74 to rotate about its central axis within the inner and outer arms 22, 24 adjusting lash of the rocker arm assembly 10 between the valve and the roller follower 52.

The bearing 50 and roller follower 52 are mounted between the first inner side arm 70 and the second inner side arm 72 on a bearing axle 80 that, during normal operation of the rocker arm assembly 10 serves to transfer energy from the rotating cam 20 to the rocker arm assembly 10. The bearing axle 80 is biased upwardly by bearing axle springs 40.

Latch lash is defined as the lash between an engaging finger 90 of the latch 32 and a complementary engaging ridge 92 on the inner arm 22. The total lash can be defined as the latch lash plus the system mechanical lash. In general, the bearing axle 80 (FIG. 1) is not in contact with the outer arm 24 when installed in the engine. Specifically, the outer arm 24 defines a kidney bean shaped opening 96 though the first and second outer side arms 64 and 66. The bearing axle 80 is offset from contacting the outer arm 24 in the opening 96. The torsion springs 40 seats the rocker arm to a ball socket 98 to prevent oil leakage from the switching circuit.

Mechanical lash can be set mechanically with a valve tip cap 100. It will be appreciated that a plurality of valve tip caps 100 may be provided having different geometries. A suitable valve tip cap 100 can be assembled between an elephant foot (e-foot) 102 and the engine valve 26 to take up the variance on the rocker arm assembly 10 between the engine valve 26, the cam 20 and the DFHLA 12.

Figure 4:
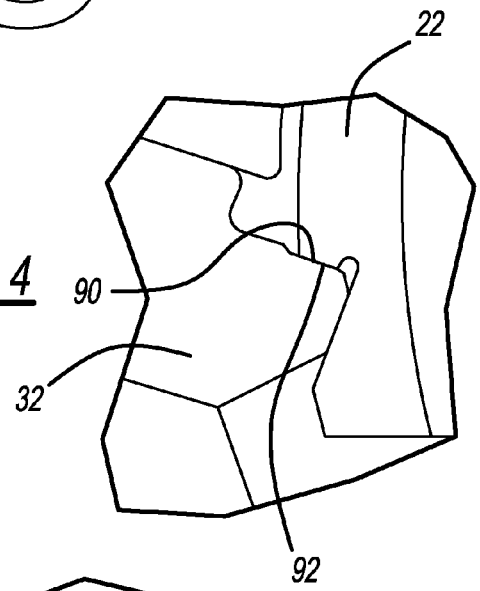
FIG. 4 is a detail side view of the switching rocker arm latch held at a zero latch lash condition.
Figure 5:
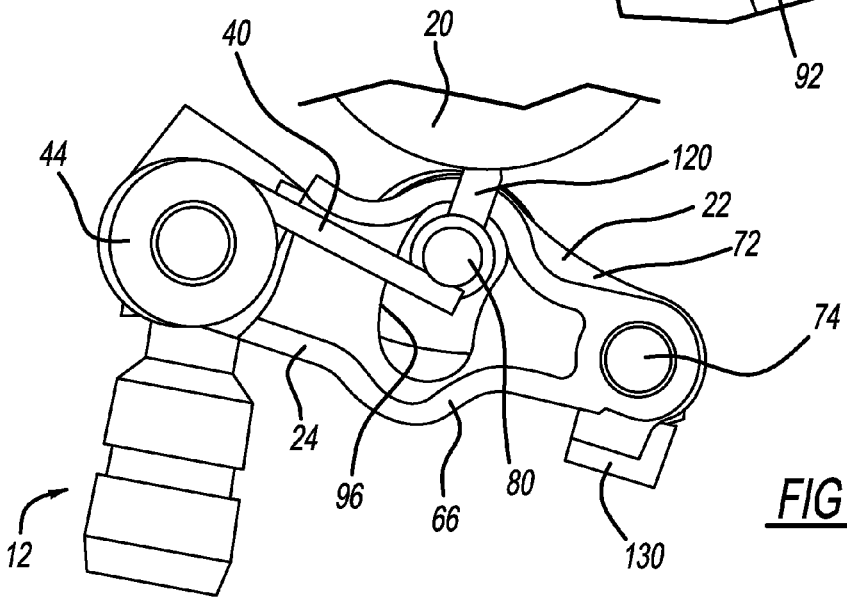
FIG. 5 is a side view of the switching rocker arm of FIG. 3 and shown with the zero latch shim installed and a master valve tip cap installed.

With particular reference now to FIGS. 3-8, additional features of the instant method for setting lash will be described. A zero lash shim 120 is inserted into the opening 96 at a gap 116 between the bearing axle 80 and the outer arm 24. The rocker arm assembly 10 is help at zero latch lash condition (FIG. 4). Specifically, the engaging finger 90 of the latch 32 is in contact with the engaging ridge 92 on the inner arm 22. As viewed in FIG. 5 the rocker arm assembly 10 is installed into the engine with a master valve tip cap 130 engaged to the valve. The valve tip cap 130 may be installed in a configuration such as shown in FIG. 2 with the valve tip cap 100 placed between an elephant foot (e-foot) 102 and the engine valve 26.

Figure 6:
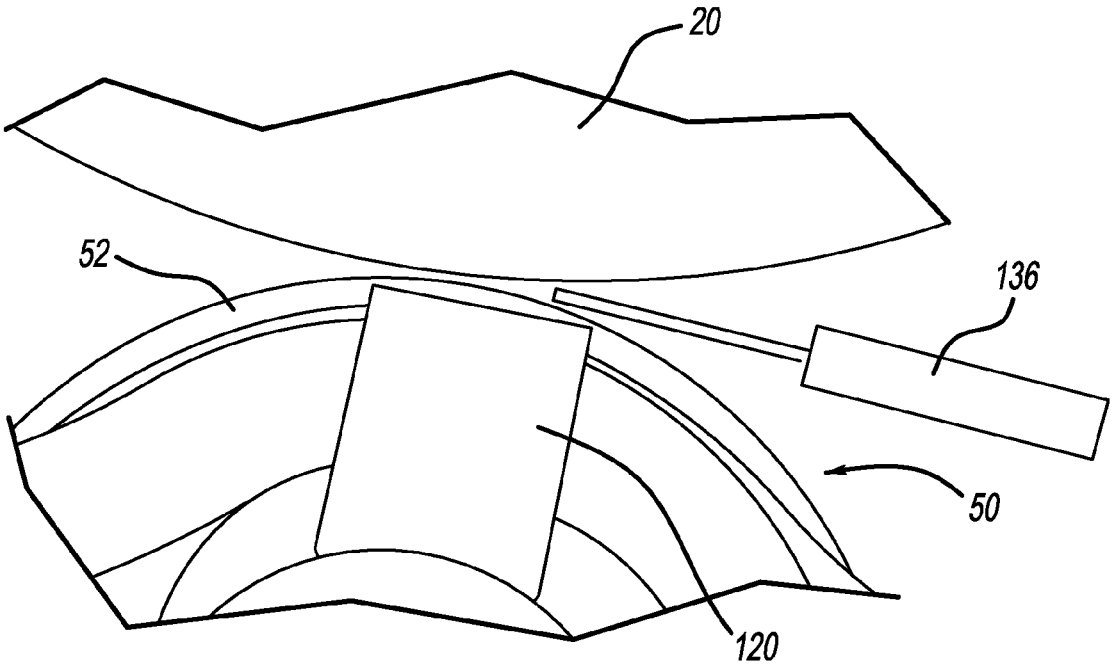
FIG. 6 is a side view of the switching rocker arm of FIG. 3 and shown with a feeler gage measuring lash at the cam interface.
Figure 7:
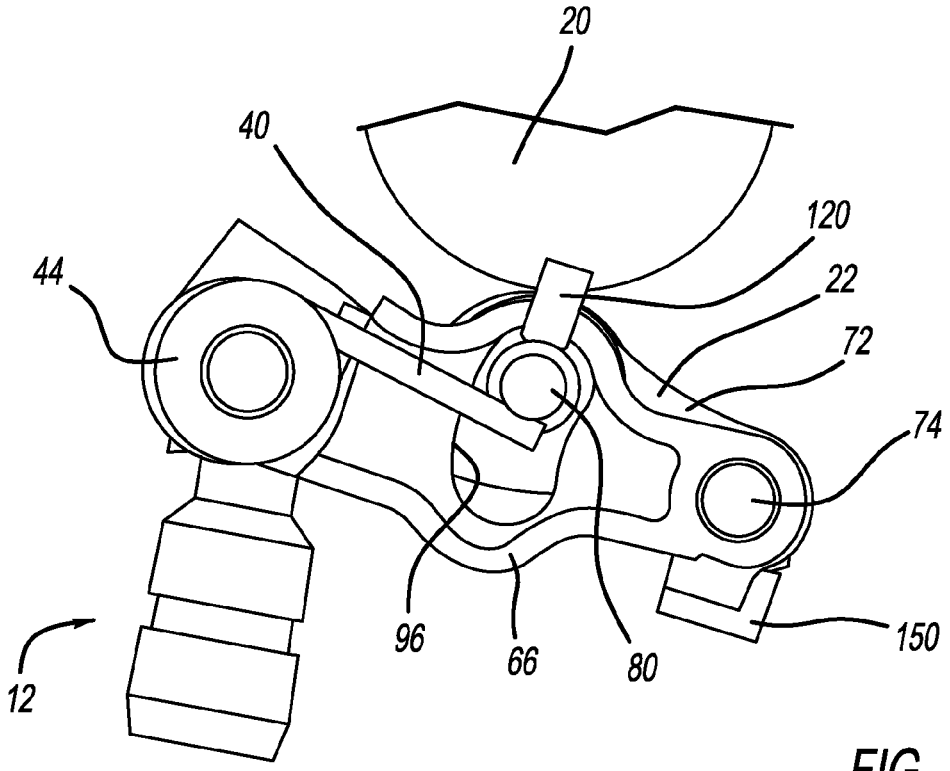
FIG. 7 is a side view of the switching rocker arm of FIG. 5 and shown with a select fit valve tip cap installed based on the master cap used in FIG. 5 and the lash measurement taken in FIG. 6.

The cam carrier is bolted in place. In FIG. 6, lash is measured between the cam 20 and the roller follower 52 with a feeler gage 136. In FIG. 7, the cam 20 and carrier, the rocker arm assembly 10, and the master tip cap 100 is removed. A select fit valve tip cap 150 is installed along with the rocker arm assembly 10, the cam 20 and carrier. It will be appreciated that the select fit valve tip cap 150 may be installed in a configuration shown in FIG. 2 that includes valve tip cap 100 placed between the elephant foot 102 and the valve 26. The size of the select fit valve tip cap 150 is based on the master cap measurement. Specifically, the select fit valve tip cap 150 is chosen from a plurality of different sized valve tip caps to have an optimal size based on the master cap used in FIG. 5 and the lash measurement taken in FIG. 6.

Figure 8:
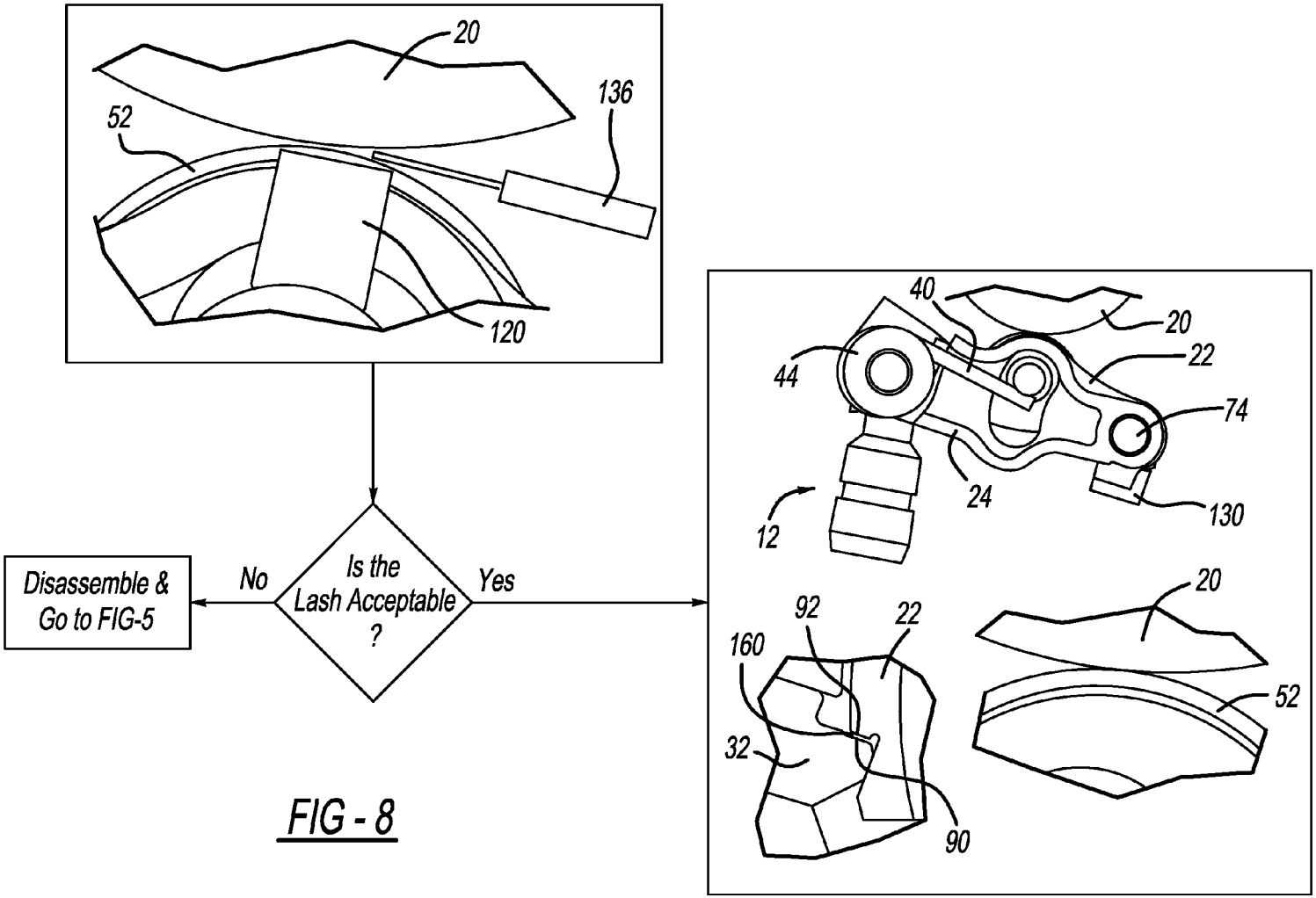
FIG. 8 is a flow chart of a lash verification procedure according to the present disclosure.

With reference now to FIG. 8, lash is measured and verified between the cam 20 and the roller follower 52 with a feeler gage 136. If the lash is not acceptable, the cam 20 and carrier, the rocker arm assembly 10 and the master tip cap 100 is disassembled and the process returns to FIG. 5 where a zero lash shim is inserted. If the lash is acceptable, the zero lash shim 120 is removed. A slight latch gap 160 is realized between the engaging finger 90 of the latch 32 and the engaging ridge 92 on the inner arm 22. The latch gap 160 now represents the lash. The torsion springs 40 push the inner arm 22 up such that the roller follower 52 touches the cam 20.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A method for setting lash on a switching rocker arm assembly, the method comprising:

providing a rocker arm having (i) an outer arm having a first outer side arm and a second outer side arm, the outer arm defining an opening, (ii) an inner arm disposed between the first and second outer side arms, (iii) a roller follower that selectively engages a cam, the roller follower mounted about a bearing axle that extends through the opening; and (iv) a pivot axle wherein the inner arm and outer arm rotate relative to each other about the pivot axle;

inserting a zero lash shim into a gap defined between the bearing axle and the outer arm at the opening;

installing the rocker arm into valvetrain with a master valve tip cap;

measuring lash between the cam and the roller follower;

removing the rocker arm and the master tip cap; and installing a select fit valve tip cap based on the master valve tip cap and the measured lash.

2. The method of claim 1 wherein inserting the zero lash shim includes placing the zero lash shim into a kidney bean shaped opening defined in the outer arm.

3. The method of claim 2 wherein subsequent to inserting the zero lash shim, the rocker arm is held at a zero lash condition.

4. The method of claim 3 wherein holding the rocker arm at the zero lash condition includes engaging a finger of a rocker arm latch in contact with an engaging ridge on the inner arm.

5. The method of claim 4 wherein installing the rocker arm into valvetrain with the master valve tip cap occurs subsequent to holding the rocker arm at the zero lash condition.

6. The method of claim 1 wherein measuring lash between the cam and the roller follower includes inserting a feeler gage between the cam and the roller follower.

7. The method of claim 1 wherein installing the select fit tip cap includes choosing a select fit tip cap from a plurality of different sized valve tip caps.

8. The method of claim 7, further comprising:

verifying lash between the cam and the roller follower subsequent to installing the select fit tip cap.

9. The method of claim 8 wherein verifying lash includes inserting a feeler gage between the cam and the roller follower.

10. The method of claim 9, further comprising:

removing the zero lash shim subsequent to the verifying.

11. The method of claim 10 wherein removing the zero lash shim includes creating a latch gap between a finger of a rocker arm latch and an engaging ridge on the inner arm, the latch gap representing the resulting lash.

12. The method of claim 10 wherein concurrent to the removing the zero lash shim the roller follower is urged into engagement with the cam.

13. The method of claim 12 wherein the roller follower is urged into engagement with the cam by at least one torsion spring acting between the inner and outer arms.

14. The method of claim 1 wherein the pivot axle secures the inner arm to the outer arm while also allowing a rotational degree of freedom wherein one of the outer and inner arms rotates relative to the other of the outer and inner arms about the pivot axle when the switching rocker arm assembly is in a deactivated state.

15. A method for setting lash on a switching rocker arm assembly, the method comprising:

providing a rocker arm having (i) an outer arm having a first outer side arm and a second outer side arm, the outer arm defining an opening, (ii) an inner arm disposed between the first and second outer side arms, (iii) a roller follower that selectively engages a cam, the roller follower mounted about a bearing axle that extends through the opening; and (iv) a pivot axle wherein the inner arm and outer arm rotate relative to each other about the pivot axle;

holding the rocker arm at a zero lash condition including moving a finger of a rocker arm latch into contact with an engaging ridge on the inner arm;

installing the rocker arm into valvetrain with a master valve tip cap;

measuring lash between the cam and the roller follower;

removing rocker arm and the master tip cap;

choosing a select fit tip cap from a plurality of different sized valve tip caps based on the master valve tip cap and the measured lash; and installing the chosen select fit valve tip cap.

16. The method of claim 15, further comprising:

verifying lash between the cam and the roller follower subsequent to installing the select fit tip cap.

17. The method of claim 16 wherein verifying lash includes inserting a feeler gage between the cam and the roller follower.

18. The method of claim 9, further comprising:

removing the zero lash shim subsequent to the verifying; and creating a latch gap between the finger of the rocker arm latch and the engaging ridge on the inner arm, the latch gap representing the resulting lash.

19. The method of claim 18 wherein concurrent to the removing the zero lash shim the roller follower is urged into engagement with the cam.

20. The method of claim 15 wherein the pivot axle secures the inner arm to the outer arm while also allowing a rotational degree of freedom wherein one of the outer and inner arms rotates relative to the other of the outer and inner arms about the pivot axle when the switching rocker arm assembly is in a deactivated state.

* * * * *